US012396494B2

(12) United States Patent
Stevens et al.

(10) Patent No.: US 12,396,494 B2
(45) Date of Patent: Aug. 26, 2025

(54) APPAREL WITH MULTI-LAYER FABRIC PANEL

(71) Applicant: Under Armour, Inc., Baltimore, MD (US)

(72) Inventors: Kayla Stevens, Baltimore, MD (US); Ofra Inselberg, Baltimore, MD (US); Abby Wittstadt, Baltimore, MD (US)

(73) Assignee: Under Armour, Inc., Baltimore, MD (US)

( * ) Notice: Subject to any disclaimer, the term of this patent is extended or adjusted under 35 U.S.C. 154(b) by 0 days.

(21) Appl. No.: 17/864,795

(22) Filed: Jul. 14, 2022

(65) Prior Publication Data

US 2023/0015684 A1 Jan. 19, 2023

Related U.S. Application Data

(60) Provisional application No. 63/221,679, filed on Jul. 14, 2021.

(51) Int. Cl.
*A41C 3/00* (2006.01)

(52) U.S. Cl.
CPC ..... *A41C 3/0014* (2013.01)

(58) Field of Classification Search
CPC ..... A41C 3/0014; A41C 3/08
USPC ..... 450/93, 23
See application file for complete search history.

(56) References Cited

U.S. PATENT DOCUMENTS

| | | | | |
|---|---|---|---|---|
| 9,936,755 | B2 | 4/2018 | Blakely et al. | |
| 2004/0003629 | A1* | 1/2004 | Mitchell | D04B 1/246 66/179 |
| 2004/0137822 | A1* | 7/2004 | Mitchell | D04B 1/102 450/75 |
| 2005/0255789 | A1* | 11/2005 | Gaudet | A41C 3/0085 450/41 |
| 2008/0070477 | A1* | 3/2008 | Barbour | A41D 15/005 450/91 |
| 2014/0109286 | A1* | 4/2014 | Blakely | A43B 23/027 2/69 |
| 2015/0223525 | A1* | 8/2015 | Miller | A41C 3/0085 450/65 |
| 2020/0214367 | A1* | 7/2020 | Kobayashi | A41C 3/12 |

* cited by examiner

*Primary Examiner* — Timothy K Trieu
(74) *Attorney, Agent, or Firm* — Maginot, Moore & Beck, LLP

(57) ABSTRACT

A brassiere includes a fabric panel including a first fabric layer and a second fabric layer. The first fabric layer includes a first material having a first modulus of elasticity and a second material having a second modulus of elasticity. The first modulus of elasticity is greater than the second modulus of elasticity. An auxetic structure is formed by the first material on the first fabric layer, the auxetic structure comprising a pattern of reentrant shapes. The second fabric layer is coupled to the first fabric layer along a perimeter portion of the fabric panel. The second fabric layer free-floating relative to the first fabric layer at a central body portion located within the perimeter portion of the fabric panel.

18 Claims, 7 Drawing Sheets

APPAREL WITH MULTI-LAYER FABRIC PANEL

CROSS-REFERENCE TO RELATED APPLICATIONS

This application claims priority from U.S. provisional patent application No. 63/221,679, filed Jul. 14, 2021, the entire contents of which are incorporated herein by reference.

FIELD

This document relates to the field of apparel, and particularly to garments and other articles of apparel to be worn or carried by a body.

BACKGROUND

Many garments are designed to fit closely to the human body. When designing an article of apparel for a close fit to the human body, different body shapes and sizes must be considered. Designing a garment with a correct fit is often difficult because individuals wearing the same size garment often have differently shaped bodies with different overall measurements. For example, two individuals with the same waist measurement may nevertheless have significantly different shapes. One may have a larger stomach while another may have larger hips. As another example, two individuals with the same bra size may have differently shaped breasts with slightly different measurements. Designing garments with a correct fit is further complicated by the fact that each individual will experience periodic changes in measurements and shapes of certain body parts. For example, waist measurements will tend to change over time as the individual gains or sheds just a few pounds of body fat and/or water weight. Similarly, female breast size and shape tends to fluctuate throughout the month. Asymmetry in breast size is also common, making it difficult for many females to find a proper fit for a single size bra.

In view of the foregoing, it would be desirable to provide a garment or other article of apparel comprised of a fabric that is capable of conforming to various body shapes within a given size range. It would also be desirable to provide a fabric that is capable of dynamically adjusting to changing body shapes over time while also conforming to various curvatures on the human body. Furthermore, it would be advantageous for such fabric to be comfortable against human skin while also managing perspiration and moisture for the wearer. In addition, it would be desirable for such a garment or article of apparel to be attractive, relatively inexpensive and easy to manufacture.

SUMMARY

In accordance with an exemplary embodiment of the disclosure, there is provided a brassiere comprising, a back portion, and a shoulder strap. The front portion includes a cup section, the cup section provided by a multi-layer fabric panel including a first fabric layer coupled to a second fabric layer. The first fabric layer comprises a first material and a second material, the first material forming an auxetic structure comprising a pattern of reentrant shapes, and the second material providing a fill portion positioned inside each reentrant shape of the auxetic structure. The second fabric layer comprises a stretch fabric. The back portion is coupled to the front portion, and the shoulder strap extends from the front portion to the back portion.

In accordance with another exemplary embodiment of the disclosure, there is provided a fabric panel arranged on a brassiere or other article of apparel. The fabric panel includes a first fabric layer and a second fabric layer. The first fabric layer includes a first material having a first modulus of elasticity and a second material having a second modulus of elasticity, the first modulus of elasticity greater than the second modulus of elasticity. An auxetic structure is formed by the first material on the first fabric layer, the auxetic structure comprising a pattern of reentrant shapes. The second fabric layer is coupled to the first fabric layer along a perimeter portion of the fabric panel, the second fabric layer free-floating relative to the first fabric layer at a central body portion located within the perimeter portion of the fabric panel.

In accordance with yet another exemplary embodiment of the disclosure, there is provided a pants garment comprising a waistband and a pelvis portion connected to the waistband. The waistband is provided by a multi-layer fabric panel including a first fabric layer coupled to a second fabric layer. The first fabric layer comprises a first material and a second material, the first material forming an auxetic structure comprising a pattern of reentrant shapes, and the second material providing a fill portion positioned inside each reentrant shape of the auxetic structure.

The above described features and advantages, as well as others, will become more readily apparent to those of ordinary skill in the art by reference to the following detailed description and accompanying drawings. While it would be desirable to provide an article of apparel that provides one or more of these or other advantageous features, the teachings disclosed herein extend to those embodiments which fall within the scope of the appended claims, regardless of whether they accomplish one or more of the above-mentioned advantages.

DESCRIPTION

Figure 1A:
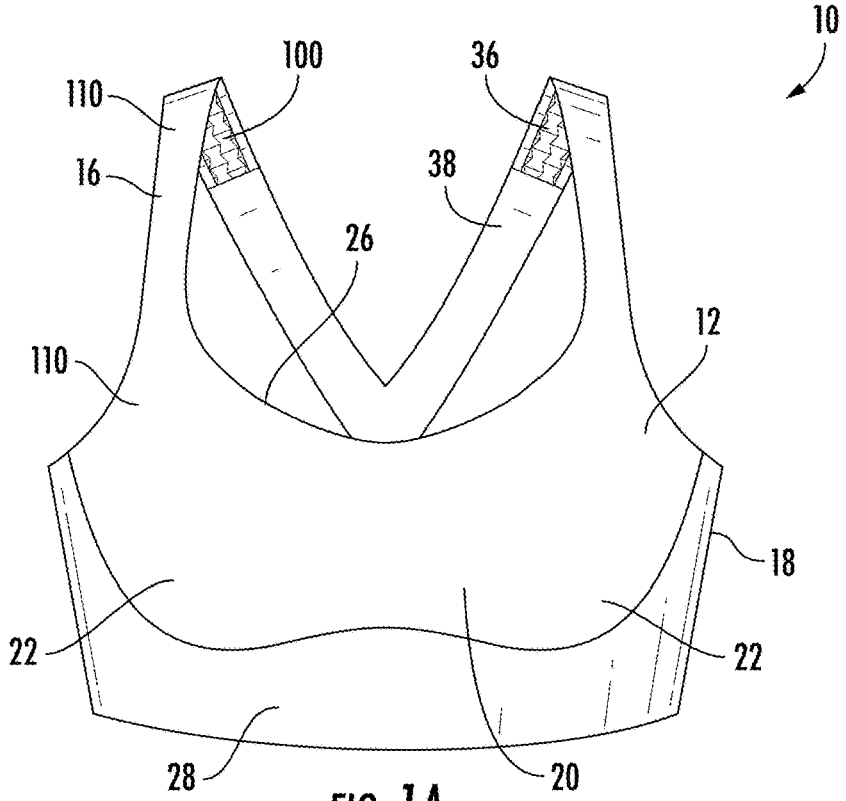
FIG. 1A is a front view of a bra including a multi-layer fabric panel having an auxetic structure.

For the purpose of promoting an understanding of the principles of the disclosure, reference will now be made to the embodiments illustrated in the drawings and described in the following written specification. It is understood that no limitation to the scope of the disclosure is thereby intended. It is further understood that this disclosure includes any alterations and modifications to the illustrated embodiments and includes further applications of the principles of the disclosure as would normally occur to one skilled in the art to which this disclosure pertains.

In the following detailed description, reference is made to the accompanying drawings which form a part hereof wherein like numerals designate like parts throughout, and in which is shown, by way of illustration, embodiments that may be practiced. It is to be understood that other embodiments may be utilized, and structural or logical changes may be made without departing from the scope of the present disclosure. Therefore, the following detailed description is not to be taken in a limiting sense, and the scope of embodiments is defined by the appended claims and their equivalents.

Aspects of the disclosure are disclosed in the accompanying description. Alternate embodiments of the present disclosure and their equivalents may be devised without parting from the spirit or scope of the present disclosure. It should be noted that any discussion herein regarding "one embodiment," "an embodiment," "an exemplary embodiment," and the like indicate that the embodiment described may include a particular feature, structure, or characteristic, and that such particular feature, structure, or characteristic may not necessarily be included in every embodiment. In addition, references to the foregoing do not necessarily comprise a reference to the same embodiment. Finally, irrespective of whether it is explicitly described, one of ordinary skill in the art would readily appreciate that each of the particular features, structures, or characteristics of the given embodiments may be utilized in connection or combination with those of any other embodiment discussed herein.

For the purposes of the present disclosure, the phrase "A and/or B" means (A), (B), or (A and B). For the purposes of the present disclosure, the phrase "A, B, and/or C" means (A), (B), (C), (A and B), (A and C), (B and C), or (A, B and C). Also, the terms "comprising," "including," "having," and the like, as used with respect to embodiments of the present disclosure, are synonymous.

With reference to FIGS. 1A-1D, an article of apparel is shown in the form of a brassiere 10 (or "bra"). The bra 10 includes a plurality of multi-layer fabric panels 90 provided in different regions of the bra 10, including a cup section 20 and shoulder straps 16. As described in detail herein, each multi-layer fabric panel 90 (which may also be referred to herein as an "auxetic fabric panel") includes a first fabric layer and a second fabric layer. An auxetic structure 120 defining a plurality of reentrant shapes is formed by one material incorporated into the first fabric layer. A fill for the reentrant shapes is provided by another material incorporated into the first fabric layer. The second fabric layer is coupled to the first fabric layer, but is free-floating relative to the first fabric layer. Together, the first fabric layer and the second fabric layer provide an improved fabric panel for an article of apparel that closely forms to various body shapes and sizes while also offering improved support and comfort for the wearer.

Multi-Layer Fabric Panel

Figure 2A:
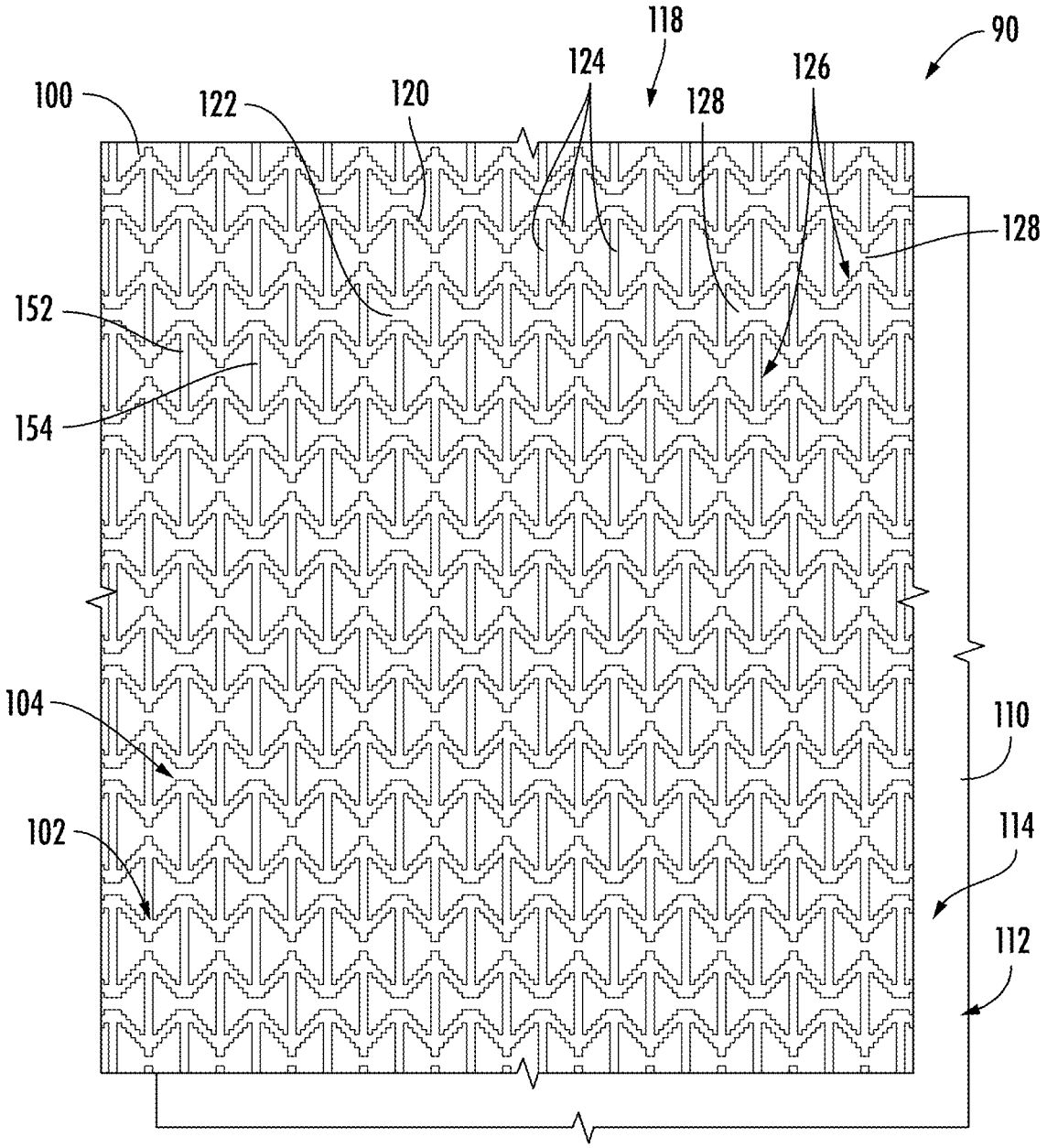
FIG. 2A is an exploded view of the multi-layer fabric panel incorporated in the bra of FIG. 1A.

With reference now to FIG. 2A, one embodiment of the multi-layer fabric panel 90 is shown. The multi-layer fabric panel 90 includes a first fabric layer 100 (or "first layer") and a second fabric layer 110 (or "second layer") that is in contact with the first layer 100. The first layer 100 is defined by a shape along a first perimeter 102. A central body portion 104 is located inwardly from the first perimeter 102 and extends across most of the area of the first layer 100. Similarly, the second layer 110 is defined by the same shape as the first layer 100 along a second perimeter 112. A central body portion 114 of the second layer 110 is located inwardly from the second perimeter 112 and extends across most of the area of the second layer 110.

The shape of the first layer 100 is in registration with the shape of the second layer 110, and the two layers 100, 110 are bonded together along to their perimeters 102, 112. This bonding be accomplished using any of various means, such as adhesives or other bonding agents. Alternatively, the first layer 100 may be connected to the second layer 110 by stitching or other connection means. The first layer 100 is bonded to the second layer 110 only along the perimeters 102, 112, and thus the central body portion 104 of the first layer 100 is free-floating relative to the central body portion 114 of the second layer 110. In other words, the central body portion 104 of the first layer 100 may be pulled away from and moved relative to the central body portion 114 of the second layer. This free-floating arrangement provides for some level of independence of the first layer 100 relative to the second layer 110, even though the two layers are connected along their perimeters.

As shown in FIG. 2A, the first layer 100 is provided by a fabric including an auxetic structure 120. The term "auxetic structure" as used herein refers to a repeating pattern of reentrant shapes that are generally recognized as providing auxetic characteristics when stress is applied to the structure, regardless of whether the structure actually has a negative Poisson's ratio. The auxetic structure 120 in FIG. 2A is provided by a plurality of auxetic hexagons having reentrant angles. When the auxetic fabric panel 90 is arranged on a garment, the auxetic hexagons are oriented in either an hourglass orientation (wherein the parallel bars on opposing ends of each hexagon are oriented generally horizontal upon the garment) or a bow-tie orientation (wherein the parallel bars on opposing ends of each hexagon are oriented generally vertical on the garment). The auxetic hexagons are shown in bow-tie orientation in the embodiment of FIG. 2A. Each of the auxetic hexagons provides one cell in an array including rows and columns of auxetic hexagons.

The first layer 100 of the multi-layer panel is formed from at least two different materials. The first material provides the auxetic structure 120. The second material provides a non-auxetic web into which the auxetic structure 120 is embedded. The second material thus provides an interior area/fill 128 within each cell of the auxetic structure 120.

Figure 2B:
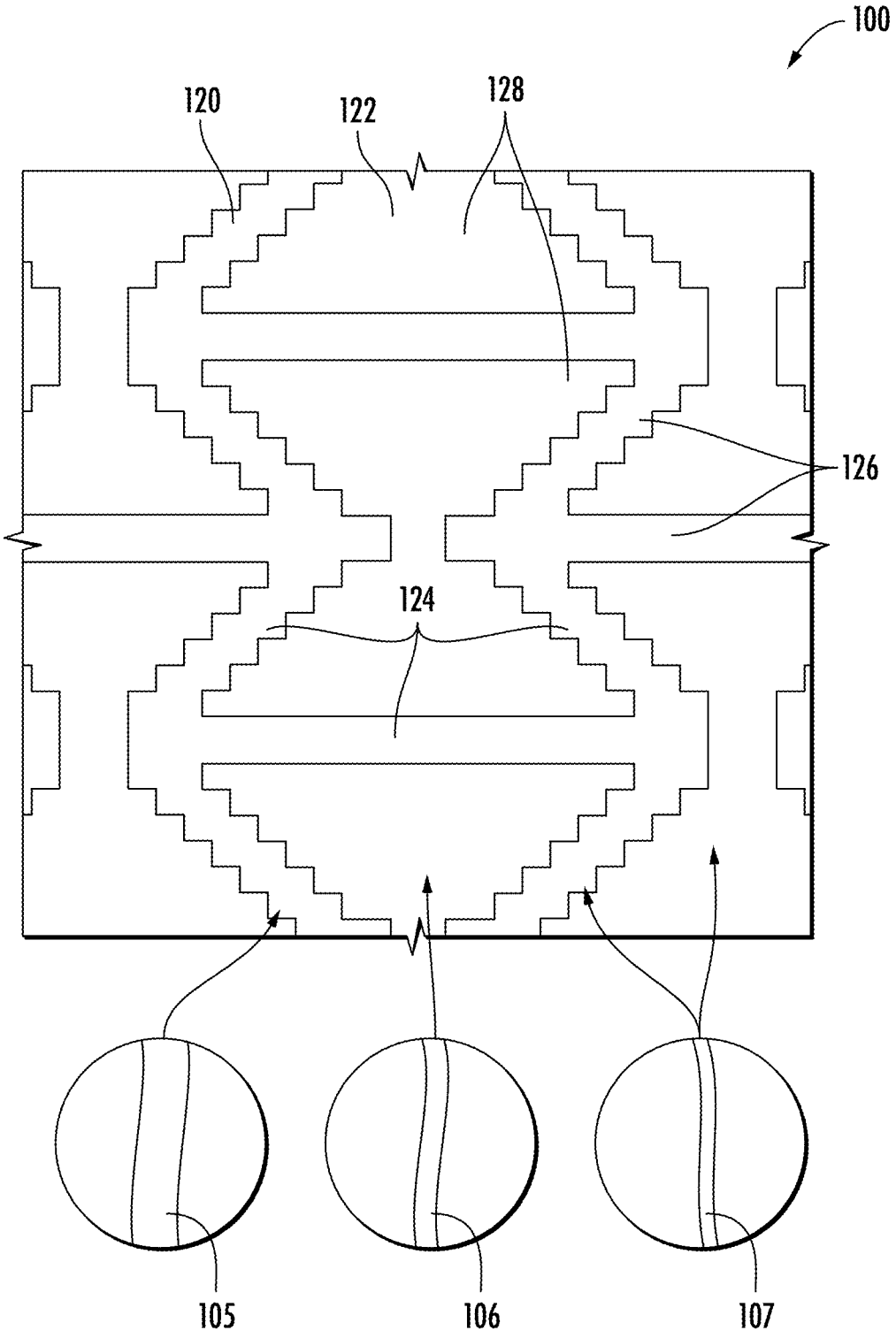
FIG. 2B is an enlarged view of the multi-layer fabric panel of FIG. 2A.

FIG. 2B shows an enlarged view of the fabric of the first layer 100 of FIG. 2A, including several enlarged auxetic hexagons. As illustrated in FIG. 2B, the first layer is formed by a plurality of yarns or other threads, including a first yarn 105, a second yarn 106, and a third yarn 107, that are knitted, woven or otherwise stitched together or interlaced to provide the fabric of the first layer 100. The yarns 105, 106 and 107 are stitched together in such a manner that the fabric includes both the auxetic structure portion 120 and the fill portion 122. As indicated in FIG. 2B, the auxetic structure portion 120 is formed of stitchings of the first yarn 105 and the third yarn 107. The fill portion 122, meanwhile, is formed of stitchings of the second yarn 106 and the third yarn 107. The term "thread" as used herein refers to a yarn or other strand of material that is used to form a fabric.

The first yarn 105 and the second yarn 106 may be comprised of any of various different materials such as polyester, nylon, thermoplastic polyurethane (TPU), spandex, or other materials as will be recognized by those of ordinary skill in the art. The first yarn 105 may be the same as or a different material from the second yarn 106. However, the denier of the first yarn 105 is greater than the denier of the second yarn 106. As used herein, the "denier" of a yarn refers to a unit of linear mass density of fibers. In general, yarns with greater deniers are thicker than yarns with lesser deniers. In the embodiment of FIG. 2B, the first yarn 105 is between 100 and 300 denier, and specifically about 150 denier; the second yarn 106 is between 33 and 100 denier, and specifically about 50 denier. In this embodiment the denier ratio of the first yarn to the second yarn is about 3:1. The third yarn 107 is comprised of an elastomer material, such as spandex or another material comprising elastane fibers. The third yarn 107 is between 50 and 150 denier, and specifically about 100 denier. The foregoing denier ranges for the first, second and third yarns are an exemplary denier ranges for yarns used in one specific garment arrangement, and it will be appreciated that other denier ranges for the yarns may be appropriate for different embodiments and different articles of apparel.

The first yarn 105 is combined (e.g., stitched together) with the third yarn 107 to form the auxetic structure portion 120 having a first modulus of elasticity. Similarly, the second yarn 106 is stitched together with the third yarn 107 to form the fill portion having a second modulus of elasticity. The term "elastic modulus" (or "modulus of elasticity") refers to a measure of the amount of force per unit area (stress) needed to achieve a given amount of deformation (strain). The higher the elastic modulus of a material, the greater the force required to deform the material to a given degree. In contrast, the lower the elastic modulus, the lesser the force required to deform the material to a given degree. In the embodiment disclosed in FIGS. 2A and 2B, both the auxetic structure portion 120 and the fill portion 122 include the third yarn 107 which is comprised of elastane fibers. Thus, both the auxetic structure portion 120 and the fill portion 122 are stretchable portions of the first layer 100. However, because the first yarn 105 used to make the auxetic structure portion 120 has a greater denier than the second yarn 106 used to make the fill portion 122, the auxetic structure portion 120 has a greater modulus of elasticity than the fill portion 122. As a result, the auxetic structure portion 120 is a more dominant structure and the fill portion 122 is a more submissive structure. Thus, the more submissive fill portion 122 tends to follow and conform to the strain on the more dominant auxetic structure portion 120 when stress forces act on the layer 110.

The auxetic structure portion 120 formed from the first yarn 105 and the third yarn 107 includes a plurality of interconnected segments 124 that form a repeating pattern of reentrant shapes 126. The reentrant shapes 126 provide a raised area relative to the fill portion 122 on one side of the fabric. Each reentrant shape 126 may also be referred to herein as a "cell" defined the by the interconnected segments 124 providing a cell wall and an interior area 128 defined within the cell wall (i.e., the area within the shape formed by the interconnected segments 124). In the embodiment of FIGS. 2A and 2B, each reentrant shape 126 is an auxetic hexagon having hourglass shape such that the auxetic structure portion forms a repeating pattern of hourglass shapes. The auxetic structure portion 120 may not provide the fabric with classic auxetic behavior, or even near-auxetic behavior, in all embodiments of the fabric. However, the auxetic structure portion 120 does provide the fabric with a surface feature that has an auxetic shape (i.e., a repeating pattern of re-entrant shapes) and contributes to a lower Poisson's ratio for the fabric. Again, the actual auxetic properties exhibited by the fabric depends on the respective properties of and combined interaction of the auxetic structure portion 120 and the fill portion 122.

As noted above, the term "auxetic structure" refers to a repeating pattern of reentrant shapes that are generally recognized as providing auxetic characteristics when stress is applied to the structure, regardless of whether the structure actually has a negative Poisson's ratio. It will be recognized that whether a structure is a truly auxetic with a negative Poisson's ratio, may depend upon the degree to which the structure is stretched. Structures may have a negative Poisson's ratio up to a certain stretch threshold, but when stretched past the threshold may have a positive Poisson's ratio. For example, it is possible that when the auxetic structure portion 120 in FIGS. 2A and 2B is stretched past a threshold expansion position, the cells and segments of the auxetic structure portion 120 may be stretched to an extent that the auxetic structure portion 120 becomes slightly thinner (in the direction perpendicular to stretch). Accordingly, the term "true auxetic" as used herein refers to structures or materials that possess or exhibit a negative (i.e., below zero) Poisson's ratio over some distance of stretch. Preferably, the structure or material possesses a negative Poisson's ratio during the entirety of the stretch. The term "near auxetic," is used herein to refer to a structure having a Poisson's ratio of approximately zero and, in particular, less than +0.20 (i.e., from about 0.0 to +0.20) over some distance of stretch. The term "lower the Poisson's ratio" is used herein to refer to structures with features that lower the Poisson's ratio of a fabric, laminate or other sheet of material. As noted in the preceding paragraph, an auxetic structure may serve to lower the Poisson's ratio of a fabric or other material, even if the material is not true auxetic or near auxetic.

With continued reference to FIGS. 2A and 2B, the fill portion 122 formed from the second yarn 106 and the third yarn 107 is a substantially smooth span of fabric that is provided on the interior area 128 of each cell 126. The fill portion 122 extends between the interconnected segments of the auxetic structure portion 120 such that the fill portion 122 of each cell 126 is spread evenly through the entirety of the interior area 128. Thus, the interior area 128 of the fabric does not include any openings or holes with the exception of the tiny passages typically associated with an air permeable fabric. Accordingly, the fabric forming the first layer 100, including both the auxetic structure portion 120 and the fill portion 122 is continuous; moreover, the fabric is not a mesh material, netting or other material that is configured with numerous relatively large passages formed therein. In at least one embodiment, the fabric is defined as having less than 25% of its surface area exposing direct openings through the fabric (e.g., less than 10% of the surface area exposes a hole in the fabric sheet that extends perpendicularly through the sheet relative to the plane defined by the fabric sheet when it is in an upstretched state).

The different fibers that are used to form the fabric (e.g., the first yarn 105, second yarn 106, and third yarn 107, described above) are woven, circular knit, warp knit, or otherwise stitched together. The fibers may be contemporaneously stitched together by a machine to form a two-sided fabric that may be removed from the machine as a unitary sheet of material. In at least one embodiment, the first layer 100 is provided by a warp-knit fabric stitched in a manner to form both the auxetic structure portion 120 and the fill portion 122. For example, the fabric may be a warp-knit jacquard fabric. In this embodiment, the auxetic structure portion 120 is raised relative to the fill portion on one side of the fabric, and the opposite side of the fabric is substantially smooth such that the auxetic structure cannot be easily detected from the opposite second side of the fabric, and the second side of the fabric appears uniform and is smooth to the touch relative to the first side. In such an embodiment, the first yarn 105 (i.e., the yarn associated with the auxetic structure portion 120) is exposed on the first side of the fabric but not on the opposite second side of the fabric, and the second yarn 106 (i.e., the yarn associated with the filler portion 122) is exposed on both the first side and the second side of the fabric. In other embodiments, the auxetic structure portion 120 may form recessed channels relative to the filler portion 122 on the opposite side of the fabric. In such embodiments, the first yarn 105 and the second yarn 106 are exposed on both sides of the fabric.

In at least one embodiment, the above-described fabric of the first layer 100 is the same as that described in U.S. Pat. No. 9,936,755, issued Apr. 10, 2018, the contents of which are incorporated herein by reference in their entirety.

With particular reference again to FIG. 2A, the second layer 110 of the auxetic fabric panel 90 is provided by a stretch fabric material which is breathable, flexible, has a sufficient elasticity to provide support during use of the bra 10, and is durable against machine-washing. In at least one embodiment, the fabric material of the second layer 110 is a compression fabric including elastane or other elastic fibers, such as a spandex fabric. Different fabric materials may be used to provide different qualities of elasticity. For example, in one embodiment a four-way stretch fabric may be used and in another embodiment a two-way stretch fabric may be used. Examples of stretch fabrics that may be used for the second layer 110 of the include HEATGEAR® and THUS™ fabrics sold by Under Armour, Inc. In at least one embodiment the second layer 110 itself is auxetic or near auxetic. Additionally, while the second layer 110 of the auxetic fabric panel 90 has been described herein as being formed from a different fabric than the first layer 100, it will be recognized that in at least some embodiments, the second layer 110 is identical to the first layer 100.

Again, the second layer 110 of the auxetic fabric panel 90 is connected to the first layer 100 along the perimeter portions 102, 112, and the central body portion 104 of the first layer 100 is free-floating relative to the central body portion 114 of the second layer 110. However, the second layer 110 is defined by a greater power (including both elastic recovery and tensile strength), and thus the second layer 110 is configured to control the stretch and drive recovery of the first layer when a strain is applied to the multi-layer fabric panel 90.

The above described auxetic fabric panel 90 of FIGS. 2A and 2B is illustrative of any number of possible embodiments of the panel. It will be recognized that modifications to this embodiment are possible, including the use of different types of threads and the arrangement of such threads within the panel, and the use of different reentrant shapes for the auxetic structures (e.g., arrowheads, twisted stars, etc.).

Bra With Multi-Layer Fabric Panel

The above-described multi-layer fabric panel 90 is particularly configured for incorporation into an article of apparel. For example, in at least one embodiment, a plurality of auxetic fabric panels 90 may be incorporated into the cups 22 and shoulder straps 16 of a bra 10, such as the bra of the embodiment of FIGS. 1A-1D.

As shown in FIGS. 1A-1D, the bra 10 generally includes a front portion 12, a rear portion 14, and shoulder straps 16. The front portion includes a cup section 20 with two cup panels 22 and a sternum bridge 24. The cup panels 22 are arranged on opposite sides of the sternum bridge 24 and are configured to cover and support the wearer's breasts. The sternum bridge 24 is located substantially in a center of the front portion 12 such that when the bra 10 is worn by a wearer, the sternum bridge 24 is generally positioned over the sternum of the wearer. The sternum bridge 24 is provided as a gore that divides the front portion 12 into a left side and a right side while also serving as an anchor structure for the cup panels 22. One cup panel 22 is arranged on each side of the sternum bridge 24 such that the cup panels 22 mirror one another on the front portion 12. In other words, one cup panel 22 is provided on the left side of the front portion 12 and the other cup panel 22 is provided on the right side of the front portion 12. In at least one alternative embodiment, the cup panels 22 of the bra 10 can be formed together as a single piece which incorporates the sternum bridge 24.

A neck 26 is formed on the front portion 12 above the cup panels 22 and the sternum bridge 24. The neck 26 provides a scooping neckline that is formed between the opposing shoulder straps 16. An under-bust 28 is formed under the cup panels 22 and the sternum bridge 24, and extends around the cup panels 22 up to an underarm section on opposite sides of the bra. The under-bust 28 further includes an elastic bust band 30 that extends along a lower perimeter on the front portion 12 of the bra 10. The bust band 30 further extends to the rear portion 14 of the bra 10 such that it completely encircles the bottom of the bra 10. The bust band is generally comprised of an elastic material that holds the bottom portion of the bra 10 securely to the torso of the wearer during use.

The rear portion 14 of the bra includes a back panel 32 that is arranged above the bust band 30. A center insert 34 is positioned in a center of the back panel 32. The center insert 34 is comprised of a mesh material which provides cooling airflow to the wearer's skin during use. The front portion 12 of the bra 10 is connected to the rear portion 14 along two side seams 18.

The shoulder straps 16 are elongated fabric panels that extend upwardly from both the front portion 12 and the rear portion 14 of the bra 10 and further couple the front portion 12 to the rear portion 14. Each shoulder strap 16 includes a first length 36 and a second length 38. The first length 36 extends upward from a seam 40 that connects the first length 36 to one of the cup panels 22 on the front portion 12 of the bra 10. The first length 36 continues to extend to a top apex of the shoulder strap 16 (i.e., over the wearer's shoulder during use) and then further extends downward along a back stretch of the strap 16. The second length 38 is connected to the first length 36 along the back stretch of the strap and extends fluidly into the back panel 32 on the rear portion.

Figure 1B:
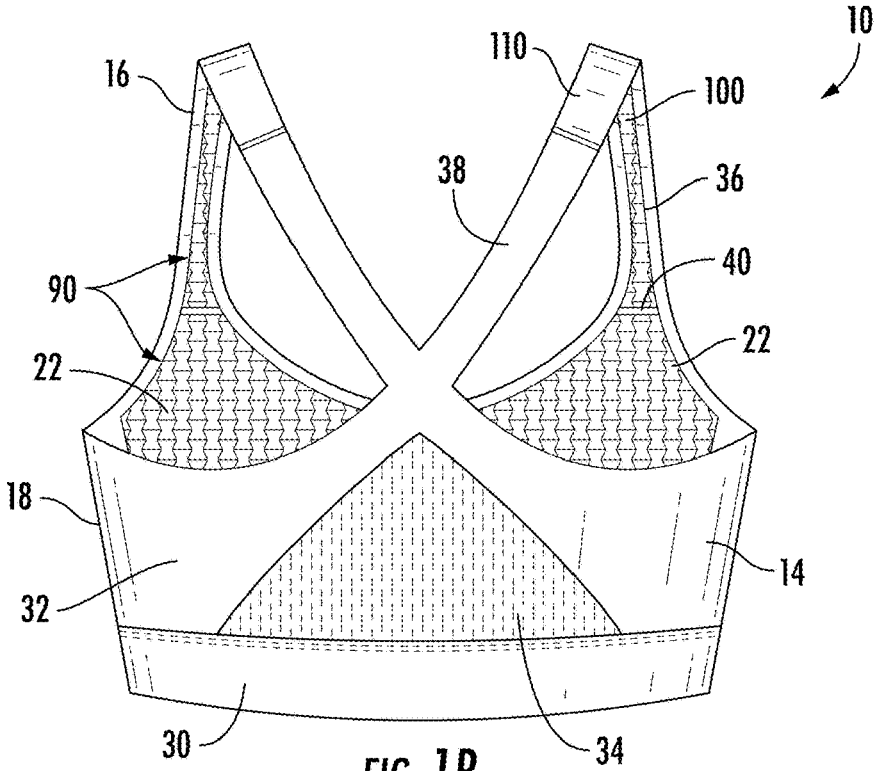
FIG. 1B is a rear view of the bra of FIG. 1A.
Figure 1C:
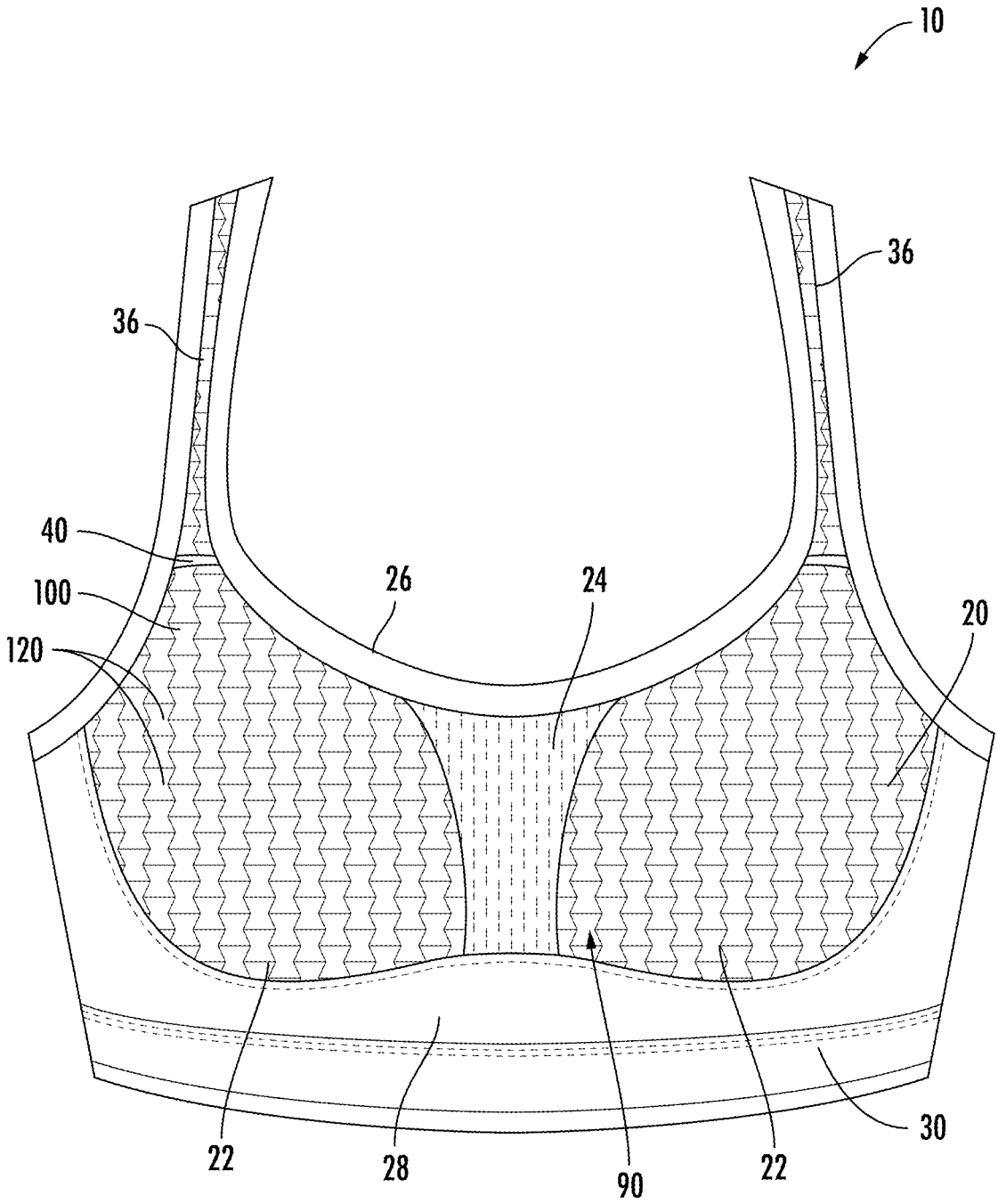
FIG. 1C is an interior view of a front portion of the bra of FIG. 1A.

In the embodiment of FIGS. 1A-1C, at least two different types of fabric panels are used to form each of the foregoing components of the bra 10. The two different types of panels include (1) the above-described auxetic fabric panel 90 and (2) a two-ply laminate panel comprised of two layers of stretch material. However, it will be recognized that in other embodiments, most or all of the bra may be formed from only the auxetic fabric panels 90.

In the embodiment of FIGS. 1A-1C, the two-ply laminate panel may be formed from two layers of stretch fabric that is the same as the fabric used as the second layer 110 of the auxetic fabric panel 90. Both layers of the two-ply stretch material are bonded together throughout the layers using a bonding means such as an adhesive or bonding tape (e.g., BEMIS® tape). This bonded configuration of the two-ply laminate panels reduces bulk in the panel and results in each layer moving together in unison. Also, the perimeters of the two-ply laminate panels are free cut so there is no stitching or overlay in portions of the bra 10 that utilize these panels.

The components of the bra 10 formed with a two-ply stretch material include the under-bust 28, the back panel 32, and the second length 38 of the shoulder straps 16. In at least one embodiment, the orientation of the two-ply stretch material is consistent throughout the various portions of the bra where it is used.

The components of the bra 10 formed with one of the auxetic fabric panels 90 as described above include the cup panels 22 and the first length 36 of the shoulder straps 16. Because each cup panel 22 is an auxetic fabric panel 90, each cup panel 22 includes a first fabric layer 100 that provides an inner layer for the cup panel 22 and a second fabric layer 110 that provides an outer layer for the cup panel 22. The inner layer 100 is coupled to the outer layer 110 along a perimeter of each cup panel 22, but a central body portion of the inner layer 100 is free-floating relative to the outer layer 110. As shown in FIGS. 1B and 1C, there is a turnover of the outer layer 110 along the perimeter of the cup panels 22, thus creating a smooth edge for the cups along the underarms and neckline.

The inner fabric layer 100 of each cup panel 22 includes an auxetic structure 120 defined by a repeating pattern of reentrant shapes. In the exemplary embodiment of FIGS. 1-4, the reentrant shapes are provided by auxetic hexagons. The auxetic hexagons are arranged in either an hourglass orientation (wherein the parallel bars of each hexagon are oriented horizontally) or a bow-tie orientation (wherein the parallel bars of each hexagon are oriented vertically). The auxetic hexagons are shown in an hourglass orientation in the embodiment of FIGS. 1A-1D. However in other embodiments, the auxetic hexagons may be differently configured, e.g., in a bow-tie orientation.

Figure 1D:
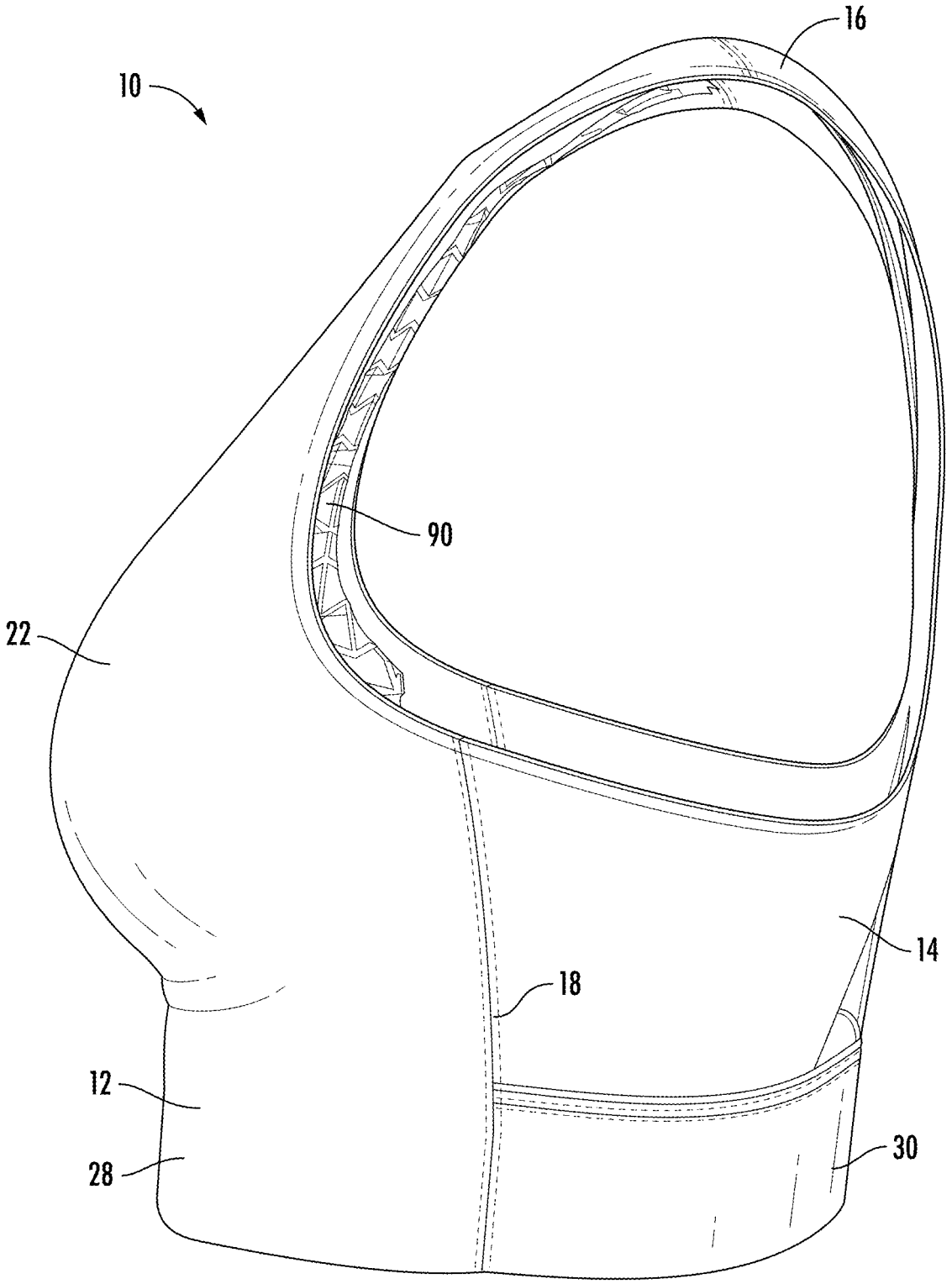
FIG. 1D is a side perspective view of the bra of FIG. 1A when worn on a body.

The construction of the auxetic fabric panels 90 prevents the need for shaping of the cup panels. Thus, the cup panels 22 are not molded, enhanced with foam padding, or otherwise shaped in any manner. Thus, the cup panels 22 are substantially flat when not worn on a body (note that FIG. 1D shows the cup panels formed when a body is wearing the bra 10). The unique construction of the auxetic fabric panels 90 allow the cup panels 22 to automatically conform into the natural shape of the wearer's breast. The auxetic structure 120 of the multi-layer fabric panel encourages auxetic behavior in the cup panels 22 when the bra is worn. When a user dons the bra, the shape of the wearers breast provides strain on the cup panels 22 in one direction (e.g., in the horizontal direction), but the cup panels actually expand or splay (as opposed to contracting) in the opposite direction (e.g., in the vertical direction). As a result, a bra is provided with increased comfort and exceptional support, where the actual shape of the bra when in use is driven by the wearer's own breast shape and size. Furthermore, because the auxetic structures encourage auxetic behavior from the cup panels 22, the bra is configured to accommodate monthly fluctuations in breast size, as well as any breast asymmetry.

Similar to the cup panels 22, the first length 36 of the shoulder straps are also formed from one of the auxetic fabric panels 90. Each length 36 includes a first fabric layer 100 that provides an inner layer and a second fabric layer 110 that provides an outer layer for the strap 16. Again, the inner layer 100 is coupled to the outer layer 110 along a perimeter of the first length 36, but the central portion of the inner layer 100 is free-floating relative to the outer layer 110. As shown in FIGS. 1A-1C, there is a turnover of the outer layer 110 along the perimeter of the strap 16, thus creating a smooth edge for the straps 16 on the shoulders of the wearer.

The inner fabric layer 100 of each first length 36 of strap 16 includes an auxetic structure 120 defined by a repeating pattern of reentrant shapes. In the exemplary embodiment of FIGS. 1-4, the reentrant shapes are provided by auxetic hexagons. The auxetic hexagons are arranged in either an hourglass orientation (wherein the parallel bars of each hexagon are oriented horizontally) or a bow-tie orientation (wherein the parallel bars of each hexagon are oriented vertically). The auxetic hexagons are arranged in an hourglass orientation in the embodiment of FIGS. 1A-1D. Because the first length 36 of the strap 16 is separated from the cup panels 22 at seam 40, the orientation of the auxetic hexagons on the strap 16 may be different from the orientation on the cup panels 22. The hourglass orientation of the auxetic hexagons on the straps 16 particularly facilitates greater horizontal expansion or splaying of the strap when a vertical load is applied along the strap (i.e., from the weight of the wearer's breast). As a result of this expansion, the first length 36 of strap 16 provides for increased comfort with less digging into the skin of the user. Furthermore, the strap 16 with a first stretch characteristic provided by the first length 36 and a second stretch characteristic provided by the second length 38 is advantageous because it provides a desired amount of stretch imbalance, with more or less stretch in the front versus back portion of the strap. This imbalance is helpful in creating a desired amount of support in the straps 16.

While the foregoing description describes use of the auxetic fabric panel 90 in a bra, it will be recognized that the auxetic fabric panel may be used in any number of other articles of apparel. Examples of other types of articles of apparel that may incorporate the auxetic fabric panel described herein include shirts, pants, shorts, sleeves, pads, shoes, hats, shoulder straps and bags, as well as numerous other garments, accessories, or other products configured to be worn on or carried by a person. Various configurations and arrangements of the auxetic fabric panel 90 are possible in each of these articles of apparel. Another example of an article of apparel incorporating the auxetic fabric panel is provided below.

Waistband with Multi-Layer Fabric Panel

In yet another alternative embodiment, the auxetic fabric panel 90 is incorporated into a waistband for a pants garment. FIGS. 5A-5C show an exemplary embodiment of a pants garment in the form of a pair of leggings 50. The leggings 50 include a waistband 52, a pelvis portion 54, and two leg portions 56. The waistband 52 is arranged at the top of the leggings 50, and is configured to encircle the waist of the wearer. The pelvis portion 54 extends downward from the waistband 52 and encircles the hips and buttocks of the wearer. The two leg portions 56 extend downward from opposite sides of the pelvis portion and are configured to cover the thighs, knees, and or calves on the leg of the wearer. Although the pants garment in FIGS. 5A-5C is illustrated as a pair of leggings 50, it will be recognized that the pants garment may take other forms such as capris pants, shorts, briefs, or any number of other pants garments.

The waistband 52 in FIGS. 5A-5C includes the above-described auxetic fabric panel 90. Accordingly, the waistband 52 includes at least one panel having an inner/first fabric layer 100 coupled to an outer/second fabric layer 110. The inner layer 100 is coupled to the outer layer 110 along a perimeter portion, but is free floating in a central body portion, as described above in association with FIGS. 2A and 2B. The inner fabric layer 100 includes at least a first material and a second material, wherein the first material forms an auxetic structure comprising a pattern of reentrant shapes, and the second material provides a fill portion positioned inside each reentrant shape of the auxetic structure. For example, the first material of the inner fabric layer may form an auxetic structure comprising a repeating pattern of auxetic hexagons, as described above in association with FIGS. 2A and 2B.

In at least one embodiment, the repeating pattern of auxetic hexagons are arranged in a bow-tie orientation on the waistband. Accordingly, when the waistband 52 is stretched in the horizontal direction, the auxetic structure of the inner layer encourages expansion of the waistband in the vertical direction. This provides additional comfort to the wearer and prevents the waistband 52 from digging into the skin of the wearer. In other embodiments, the auxetic hexagons could also be arranged in the hourglass orientation.

The outer fabric layer 110 may be a stretch fabric that is the same as that described above in association with FIGS. 2A and 2B. Alternatively, in at least one embodiment, the outer layer 110 is the same as the inner layer with the auxetic hexagons arranged in the same orientation in both the inner layer and the outer layer (i.e., both in either the hourglass orientation or the bow-tie orientation).

In at least one embodiment, the auxetic fabric panel 90 of the waistband completely encircles the wearer, extending from a front to a back of the waistband 52. In other embodiments, the auxetic fabric panel 90 is only provided on the back of the waistband, and is connected to a front stretch fabric panel (e.g., the above-described two-ply stretch panel) along a side seam.

Figure 3A:
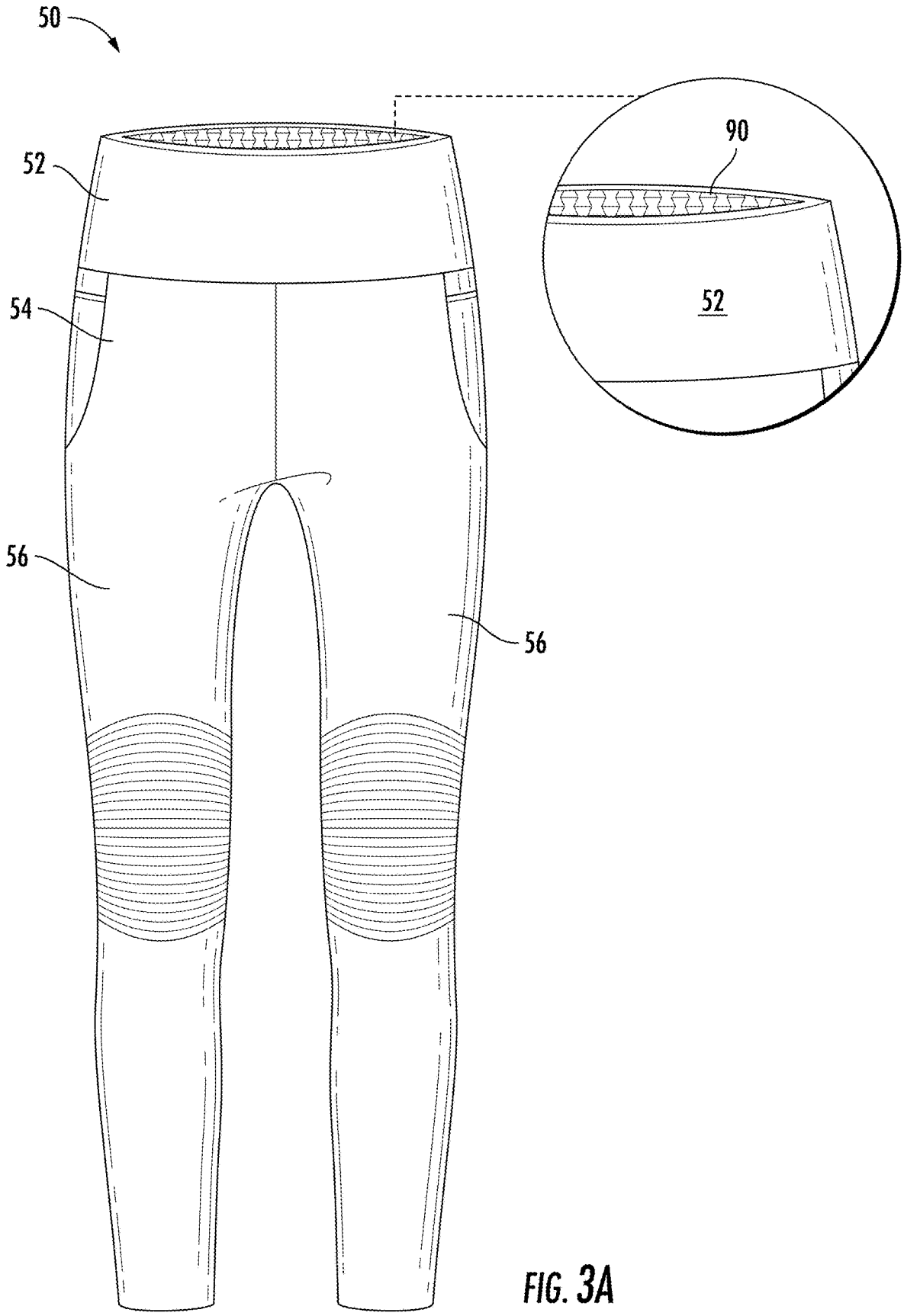
FIG. 3A is a front view of a pant garment including the multi-layer fabric panel of FIG. 2A.
Figure 3B:
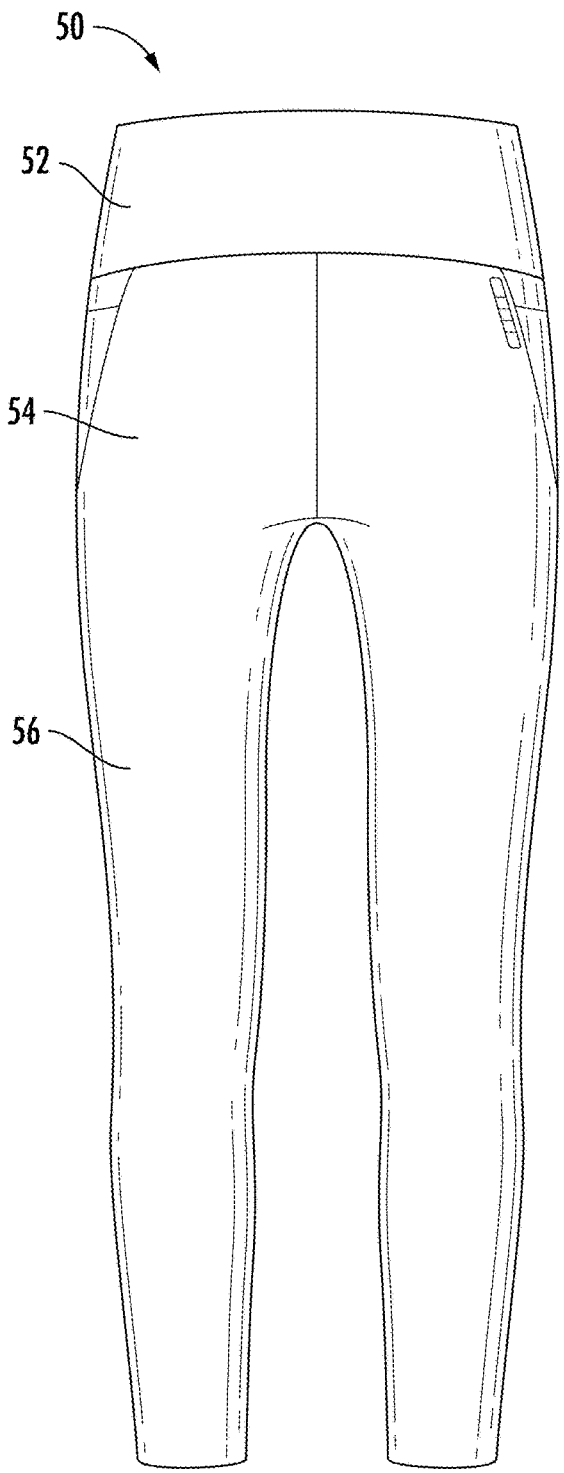
FIG. 3B is a rear view of the pant garment of FIG. 3A.
Figure 3C:
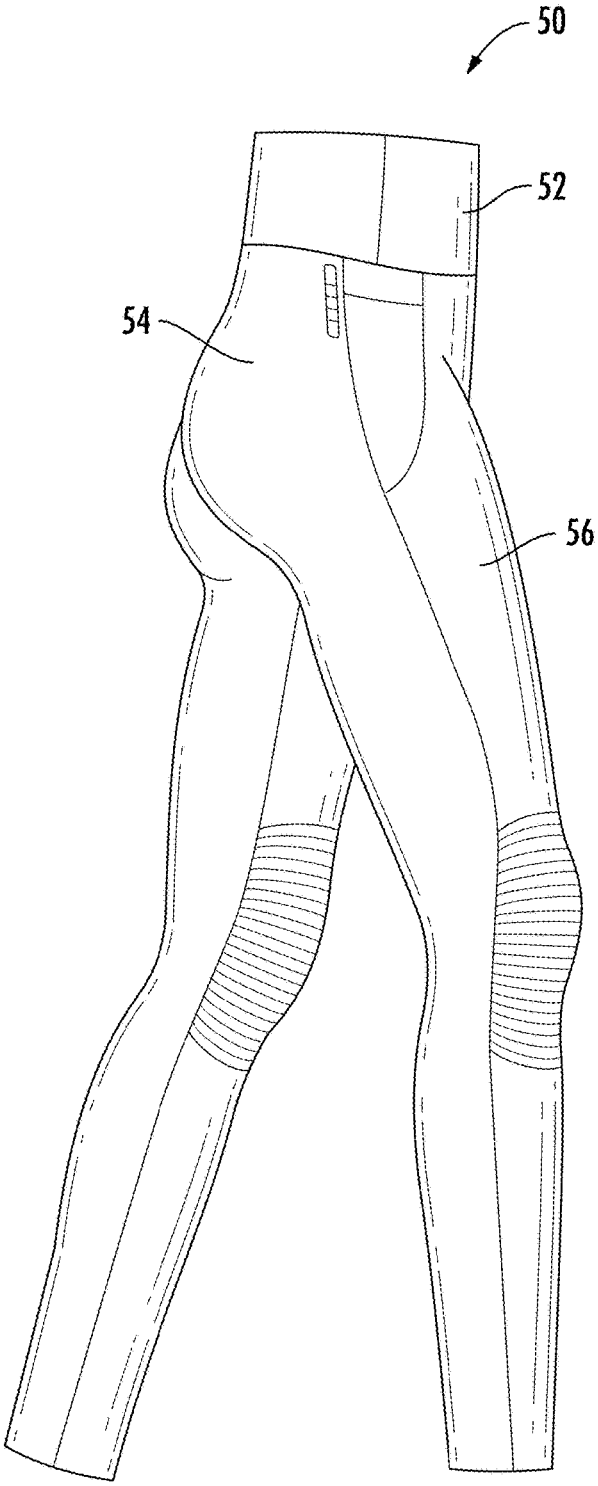
FIG. 3C is a side view of the pant garment of FIG. 3A.

The above-described waistband 52 of FIGS. 3A-3C provides similar advantages to that of the bra 10 described in association with FIGS. 1A-1D. For example, the waistband is configured to comfortably fit different body shapes within a same waist size. Additionally, the waistband is a stretch waistband that is capable of naturally fitting the shape and size of the wearer regardless of moderate periodic changes in waist size. Furthermore, the auxetic structures provided in the waistband provide a comfort fit that generally reduces digging into the skin of the wearer.

The foregoing detailed description of one or more exemplary embodiments of the apparel with multi-layer fabric panel has been presented herein by way of example only and not limitation. It will be recognized that there are advantages to certain individual features and functions described herein that may be obtained without incorporating other features and functions described herein. Moreover, it will be recognized that various alternatives, modifications, variations, or improvements of the above-disclosed exemplary embodiments and other features and functions, or alternatives thereof, may be desirably combined into many other different embodiments, systems or applications. Presently unforeseen or unanticipated alternatives, modifications, variations, or improvements therein may be subsequently made by those skilled in the art which are also intended to be encompassed by the appended claims. Therefore, the spirit and scope of any appended claims should not be limited to the description of the exemplary embodiments contained herein.

What is claimed is:

1. A brassiere comprising: a front portion including a cup section, the cup section provided by a multi-layer fabric panel including a first fabric layer coupled to a second fabric layer, the first fabric layer comprising a first material and a second material, the first material forming an auxetic structure comprising a pattern of reentrant shapes, and the second material providing a fill portion positioned inside each reentrant shape of the auxetic structure, and the second fabric layer comprising a stretch fabric; a back portion coupled to the front portion; and a shoulder strap extending from the front portion to the back portion; wherein the cup section is a left cup section, the brassiere further comprising a right cup section with a sternum bridge positioned between the left cup section and the right cup section, wherein the multi-layer fabric panel is a dual-layer fabric panel providing the left cup section, wherein the second fabric layer is coupled to the first fabric layer along a perimeter portion of the dual-layer fabric panel including the sternum bridge, and wherein the second fabric layer is free-floating relative to the first fabric layer at a central body portion located within the perimeter portion of the dual-layer fabric panel such that a central body portion of the first layer may be pulled away from and moved relative to the central body portion of the second layer.

2. The brassiere of claim 1, wherein the back portion also comprises the stretch fabric, wherein the stretch fabric of the back portion includes two layers of the stretch fabric bonded together.

3. The brassiere of claim 1, wherein at least a first length of the shoulder strap is also provided by the multi-layer fabric panel.

4. The brassiere of claim 3, wherein the pattern of reentrant shapes is in a first orientation on the cup section and in a second orientation on the first length of the shoulder strap.

5. The brassiere of claim 4, wherein each of the reentrant shapes is an auxetic hexagon, and wherein the first orientation is an hourglass orientation and the second orientation is a bow-tie orientation.

6. The brassiere of claim 3, wherein the first length of the shoulder strap extends along a front section of the strap that is connected to the cup section, wherein a second length of the shoulder strap extends along a back section of the strap that is connected to the back portion, and wherein the second length of the shoulder strap is provided by the stretch fabric.

7. The brassiere of claim 1, wherein the multi-layer fabric panel is near auxetic or true auxetic.

8. The brassiere of claim 1, wherein the auxetic structure lowers the Poisson's ratio of the multi-layer fabric panel.

9. A brassiere with a fabric panel arranged on the brassiere, the fabric panel comprising: a first fabric layer including a first material having a first modulus of elasticity and a second material having a second modulus of elasticity, the first modulus of elasticity greater than the second modulus of elasticity, wherein an auxetic structure is formed by the first material on the first fabric layer, the auxetic structure comprising a pattern of reentrant shapes; and a second fabric layer coupled to the first fabric layer along a perimeter portion of the fabric panel, the second fabric layer free-floating relative to the first fabric layer at a central body portion located within the perimeter portion of the fabric such that a central body portion of the first layer may be pulled away from and moved relative to the central body portion of the second layer; wherein the brassiere includes breast cups and shoulder straps, and wherein the fabric panel is a plurality of fabric panels arranged on the breast cups and on the shoulder straps, and wherein the perimeter portion of the fabric panels arranged on the breast cups are coupled to a sternum bridge positioned between the breast cups.

10. The brassiere of claim 9, wherein the first fabric layer is an inner layer of the brassiere and the second fabric layer is an outer layer of the brassiere.

11. The brassiere of claim 9, wherein the second material of the first fabric layer provides a fill portion formed by a plurality of stitches positioned inside of each reentrant shape of the auxetic structure, and wherein the fill portion substantially fills an interior area defined by each reentrant shape.

12. The brassiere of claim 11, wherein the first fabric layer is comprised of a warp-knit jacquard fabric wherein the auxetic structure is raised relative to the fill portion on one side of the first fabric layer.

13. The brassiere of claim 9, wherein the second fabric layer is comprised of a two-way or four-way stretch fabric.

14. The brassiere of claim 13, wherein the second fabric layer is defined by a greater power than the first fabric layer, the greater power defined by the second fabric layer having a greater elastic recovery and greater tensile strength than the first layer such that the second layer controls stretch and drives recovery of the first fabric layer.

15. The brassiere of claim 9, wherein the pattern of reentrant shapes are auxetic hexagons arranged in an hourglass orientation on the article of apparel.

16. The brassiere of claim 9, wherein the pattern of reentrant shapes are auxetic hexagons arranged in a bow-tie orientation on the article of apparel.

17. The brassiere of claim 9, wherein the fabric panel is near auxetic or true auxetic.

18. The brassiere of claim 9, wherein the auxetic structure lowers the Poisson's ratio of the fabric panel.

* * * * *